US005735101A

United States Patent [19]

Shing-Tak Lam

[11] Patent Number: 5,735,101

[45] Date of Patent: Apr. 7, 1998

[54] TAPE MANAGEMENT SYSTEM

[75] Inventor: Joe Augustine Shing-Tak Lam, Richmond, Canada

[73] Assignee: Belcor Industries Inc. Canada

[21] Appl. No.: 695,117

[22] Filed: Aug. 5, 1996

[51] Int. Cl.[6] ..... B65B 61/00

[52] U.S. Cl. ..... 53/136.1; 156/361; 53/64; 53/76; 53/505

[58] Field of Search ..... 53/136.1, 136.3, 53/136.4, 389.2, 64, 52, 75, 505, 76; 156/351, 361, 362, 363, 355, 366

[56] References Cited

U.S. PATENT DOCUMENTS

| | | | |
|---|---|---|---|
| 4,199,911 | 4/1980 | Miyazaki et al. | 53/505 |
| 4,501,105 | 2/1985 | Rogers et al. | 53/64 |
| 4,554,775 | 11/1985 | Asami et al. | 53/64 |
| 4,640,731 | 2/1987 | Lerner et al. | 156/355 |
| 4,781,786 | 11/1988 | Lerner et al. | 53/136.4 |
| 4,784,714 | 11/1988 | Shibata | 156/355 |
| 4,821,487 | 4/1989 | James et al. | 53/136.4 |
| 5,163,264 | 11/1992 | Hannen | 53/64 |
| 5,503,702 | 4/1996 | Filicicchia et al. | 156/361 |
| 5,556,492 | 9/1996 | Vonderhorst et al. | 156/361 |

*Primary Examiner*—John Sipos
*Assistant Examiner*—John Paradiso
*Attorney, Agent, or Firm*—C. A. Rowley

[57] ABSTRACT

A tape applicator having a displaceable front contact roller movable from an extended position to a retracted position and a detector positioned on the tape applicator so that movement of the tape with the front roller relatively positions the detector and tape in sensing position wherein the detector may detect the presence or absence of a tape along a tape path leading to the front roller. The detector is only activated when the tape and detector are in the sensing positions permitting detection of the tape. This is preferably accomplished in a conventional tape applicator with a cutoff knife by mounting the detector on the cutoff mechanism so that both the detector and the tape are moved toward each other to assume the required relative positions wherein the detector can detect the tape and activate a warning system in the event no tape is detected. Also disclosed is a tape applicator having a detector to sense when the tape cutter has failed to cut the tape.

10 Claims, 15 Drawing Sheets

TAPE MANAGEMENT SYSTEM

FIELD OF INVENTION

The present invention relates to a tape detector, more particularly, the present invention relates to a detector for determining whether or not a tape is in position to be applied to a carton by a taping head.

BACKGROUND OF THE INVENTION

Tape dispensers of a type intended to be improved by the present invention generally include a front roller and a rear roller interconnected for movement together between a retracted and an extended positions. Generally, a cutoff mechanism is positioned between the two rollers and is movable by cam contact with the leading edge of a carton being taped into position from which it is released to cut the tape when the cutoff cam clears the rear end of the carton being taped. Such a device is shown, for example, in U.S. Pat. No. 5,440,852 issued Aug. 15, 1995 to Lam.

To Applicant's knowledge, no effective system is available or known to monitor the tape to determine whether or not it has been broken and thus, the container or box not properly taped.

BRIEF DESCRIPTION OF THE PRESENT INVENTION

It is an object of the present invention to provide a tape detector for detecting the presence of tape adjacent to its point of application to a carton so that the operator may be warned if the tape is not in proper position.

Broadly, the present invention relates to a tape applicator having detector for detecting the operation of a tape in said tape applicator adjacent to the point of application of the tape to an article being taped, said tape applicator having a frame, a front contact roller mounted on said frame for movement between an extended position and a retracted position, means to provide tape to said front roller along a tape path, a detector means, means for mounting said detector means, means for activating said detector means when said front roller is in a retracted position and said detector is in a sensing position relative to said tape path to permit said detector to detect whether said tape is in said path approaching said roller when tape is being applied to said article by said tape applicator and for deactivating said detector means when said front roller is outside of said retracted position.

Preferably means for mounting said detector means moves said detector means into said sensing position from a retracted position.

Preferably, said means for mounting said detector means comprises a cam means mounted on said frame for movement from a first to a second position by movement of said article being taped along a path, said movement of said cam means to said second position positioning said detector means in said sensing position.

Preferably, said means to activate comprises a pin extending from said frame.

Preferably, said detector means includes a feeler arm said feeler arm positioned to bear against said tape on said tape path when said detector means is in said sensing position and said front roller is in said retracted position, said feeler arm and said pin being constructed and positioned to bear against each other and prevent activation of said detector when said detector means is not in said sensing position, and to releases said feeler arm when said detector means is in sensing position and said feeler arm is in position to contact said tape in said path and to permit movement of said feeler arm to trigger said detector means if such movement of said feeler arm is not prevented by contact of said feeler arm with said tape on said path.

Preferably, said tape applicator will further include a rear roller, and means interconnecting said front and rear roller for movement together.

Preferably, said cam means is positioned between said front and rear rollers along said path of movement of an article being tape so that said article being taped displaces the cam mean.

Preferably, said cam means mounts a cutoff knife.

Preferably said detector means is fixed relative to said frame.

Preferably, said tape applicator will further comprise a position detector sensing when said front contact roller is out of said extended position and means for activating said position detector to provide a signal.

Preferably, said means for activating said position detector to provide a signal will comprise a timer set to trigger a signal when said position detector has been in activated position for a pre-selected period of time.

Preferably, said means to activate comprises an article detector to activate position detector only when no article is in taping position.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1A:
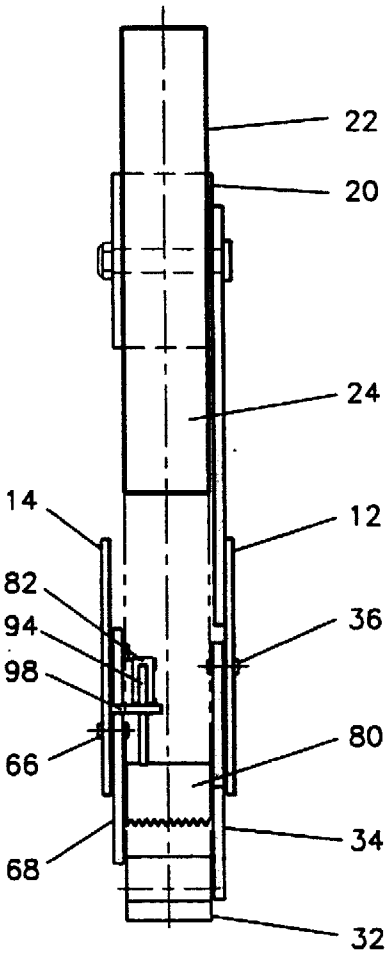
FIG. 1A is a from elevation looking in the direction of the arrow A in FIG. 1.

The illustrated tape applicator is a typical tape applicator for applying tape to a an article such as a container, carton, box or the like for sealing or applying a reinforcing tape or the like to the article and is composed of a main or rear frame panel 12 and auxiliary frame panel 14 (see FIG. 1A) fixed to frame 12. The frame 14 has only been shown in FIG. 1A and has been omitted from the other Figures to more clearly illustrate the present invention.

An arm 18 is connected to the frame 12 and projects away from the frame and mounts a reel 20 for ratably mounting a roll 22 of tape. The reel 20 may include means for detecting whether the roll 22 is rotating at the proper time and if not, to provide a further indication of a tape break.

The tape 24 is peeled off the roll 22 with its adhesive side facing the roll 22 and passing on the outside of guide roll 26 around a clutch and break roll 28 with the adhesive side pressed against the roll 28, then over a further guide roll 30 and onto a front contact roller 32. The front contact roller 32 is mounted at the free end of an arm 34 which is pivotably mounted to the frame 12 as indicated at 36. The guide roll 30 is also mounted on the arm 34 for movement with the front lead contact roller 32. A connecting link 40 is pivotably connected as indicated at 42 to the arm 34 and at its opposite end to an arm 44 via pivotable connection 46 so that movement of arm 34 on pivot 36 as indicated by the arrow 38 results in a corresponding movement of the arm 44 about pivot 48 as indicated by the arrow 63.

The arm 44 is pivotably mounted on frame 12 on an axle 48 and is urged into extended position via a spring 50 which holds an edge 52 of the arm 44 against a stop 54. The spring 50 which is bias between the arm 44 and a pin 56 on the frame 12 also biases the arm 34 to extended position where the leading edge 58 of the arm 34 bears against a stop 60 anchored to the frame 12.

Figure 1:
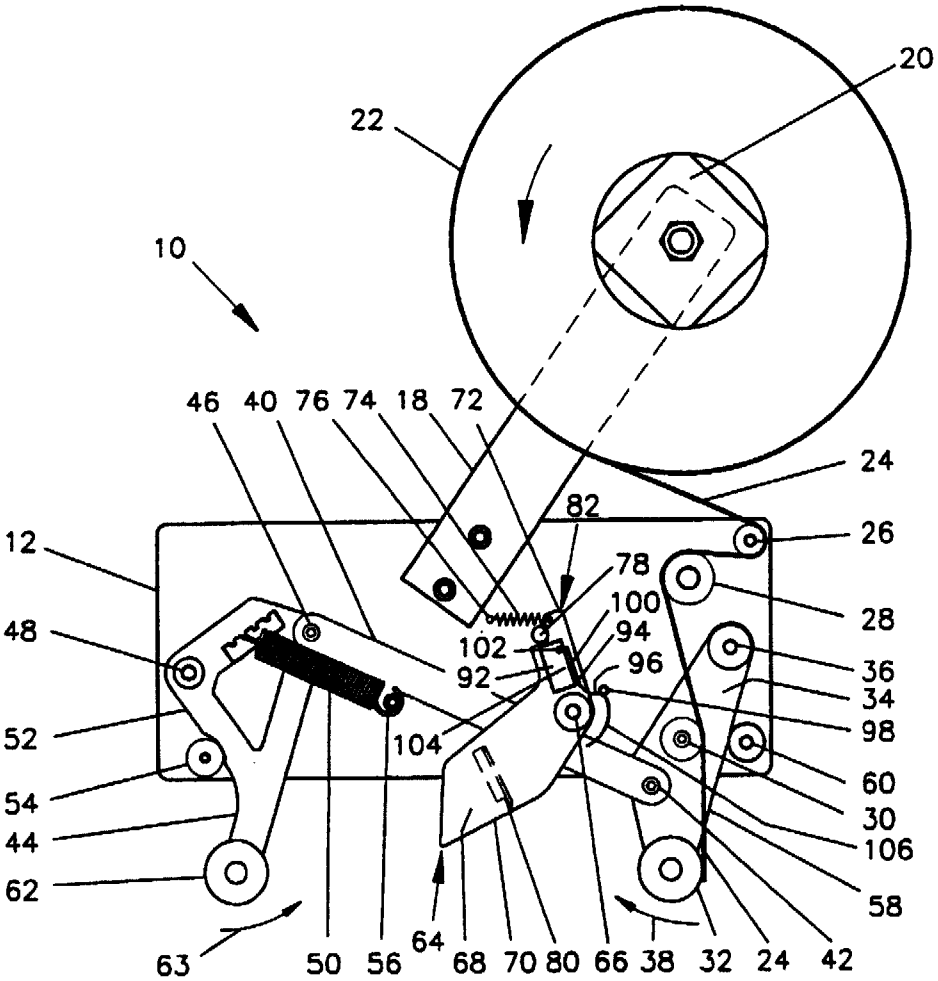
FIG. 1 is a side elevation schematically illustrating a conventional tape applicator with cutoff blade but incorporating the present invention.

A trailing or rear contact roller 62 is mounted at the extended free end of the arm 44 which is shown in FIG. 1 in extended position projecting into the path of article to be taped by taper 10.

Positioned between the arms 34 and 44 is a cutoff mechanism 64 which is pivotably mounted to the auxiliary frame 14 via axle 66. The cutoff mechanism 64 includes front section arm 68 having a lead cam surface 70 and rear section arm 72 on the side of the pivot 66 remote from the surface 70. A spring 74 extends between the free end of arm 72 and a pin 76 fixed to the auxiliary frame 14 and biases the arm 72 against an abutment or stop 78 also fixed to the auxiliary frame 14 to hold the cutoff mechanism 64 and thus arm 68 in a first position extending from the frame 14 as illustrated in FIGS. 1 and 2.

The cutoff mechanism 64 further includes a cutoff blade 80 mounted part way on arm 68 spaced from the pivot point 66. The blade 80 extends the full width of the tape 24 and functions to cut the tape 24 after the proper length has been applied to a carton or the like as will be described hereinbelow. Thus, the arm 68 is positioned to one side of the path travel of the tape 24 and the arms 34 and 44 are on the other side of the path of travel of the tape 24.

Figure 2:
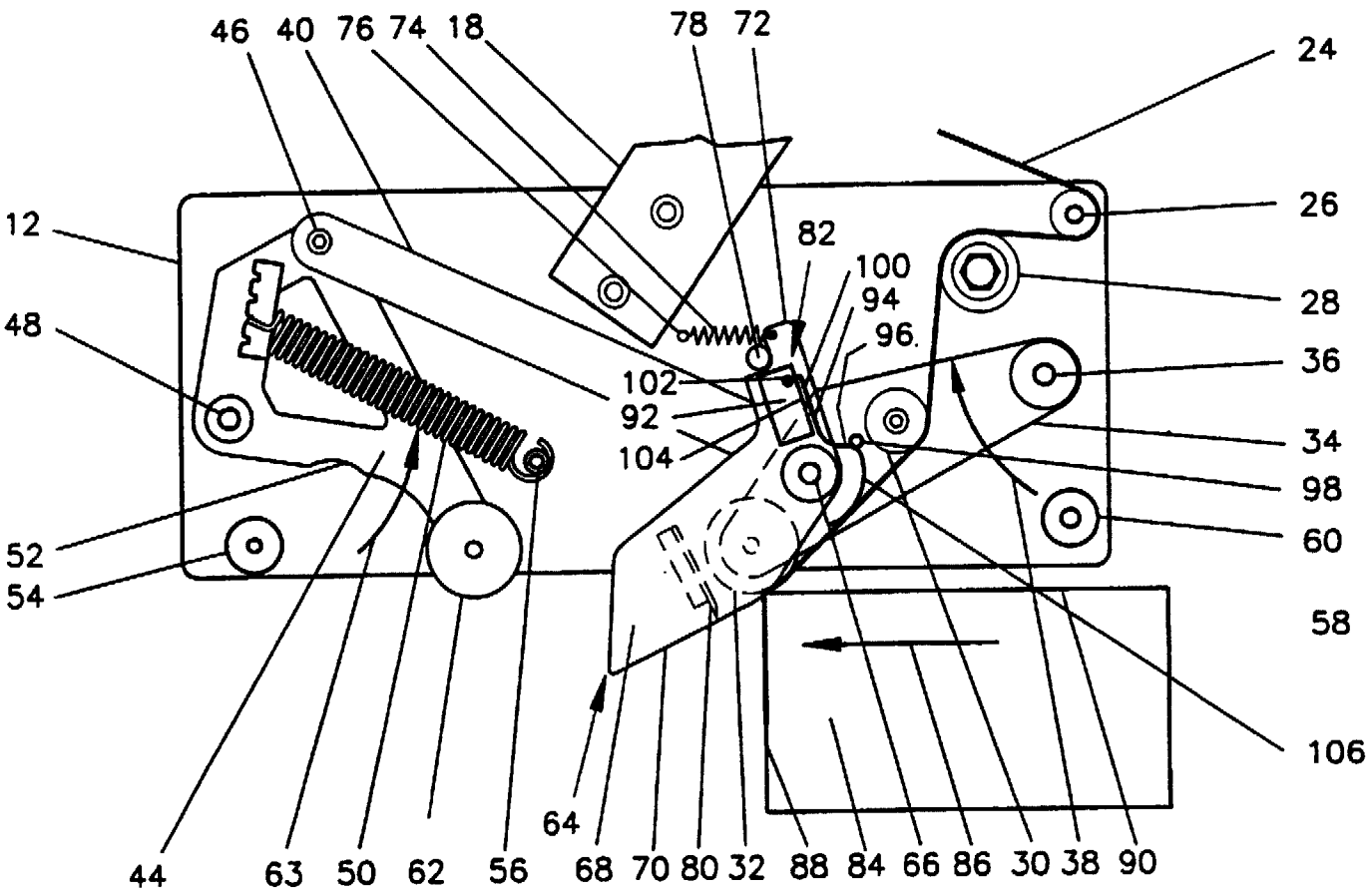
FIG. 2 is similar to FIG. 1 but showing an article to be taped (e.g. a carton or the like) moving relative to the tape applicator along a taping path to move the front roller into retracted position.
Figure 3:
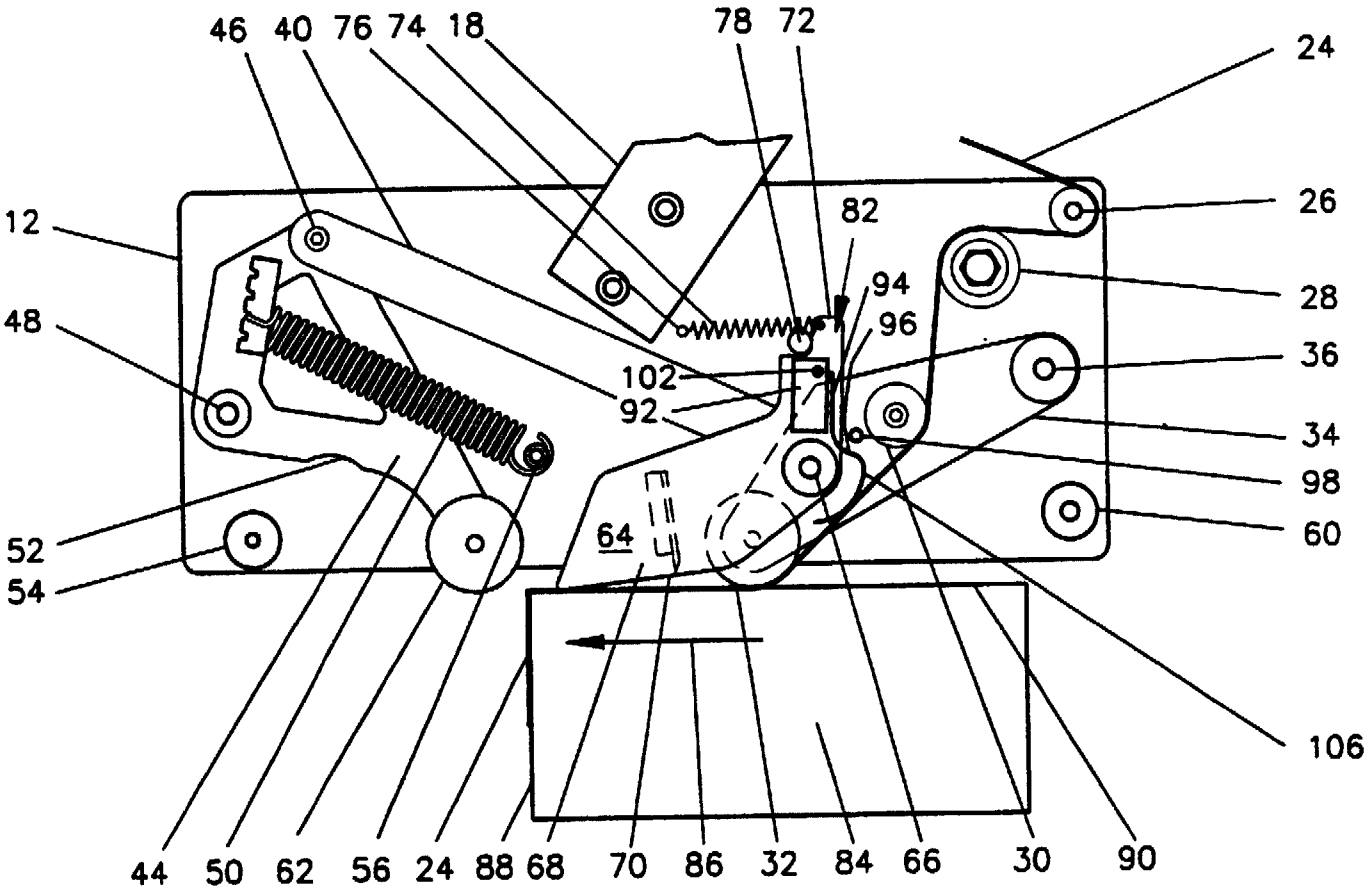
FIG. 3 shows the article further through the tape mechanism along the taping path with the cutoff knife cam fully cocked and the detector in sensing position to detect the presence of the tape.
Figure 4:
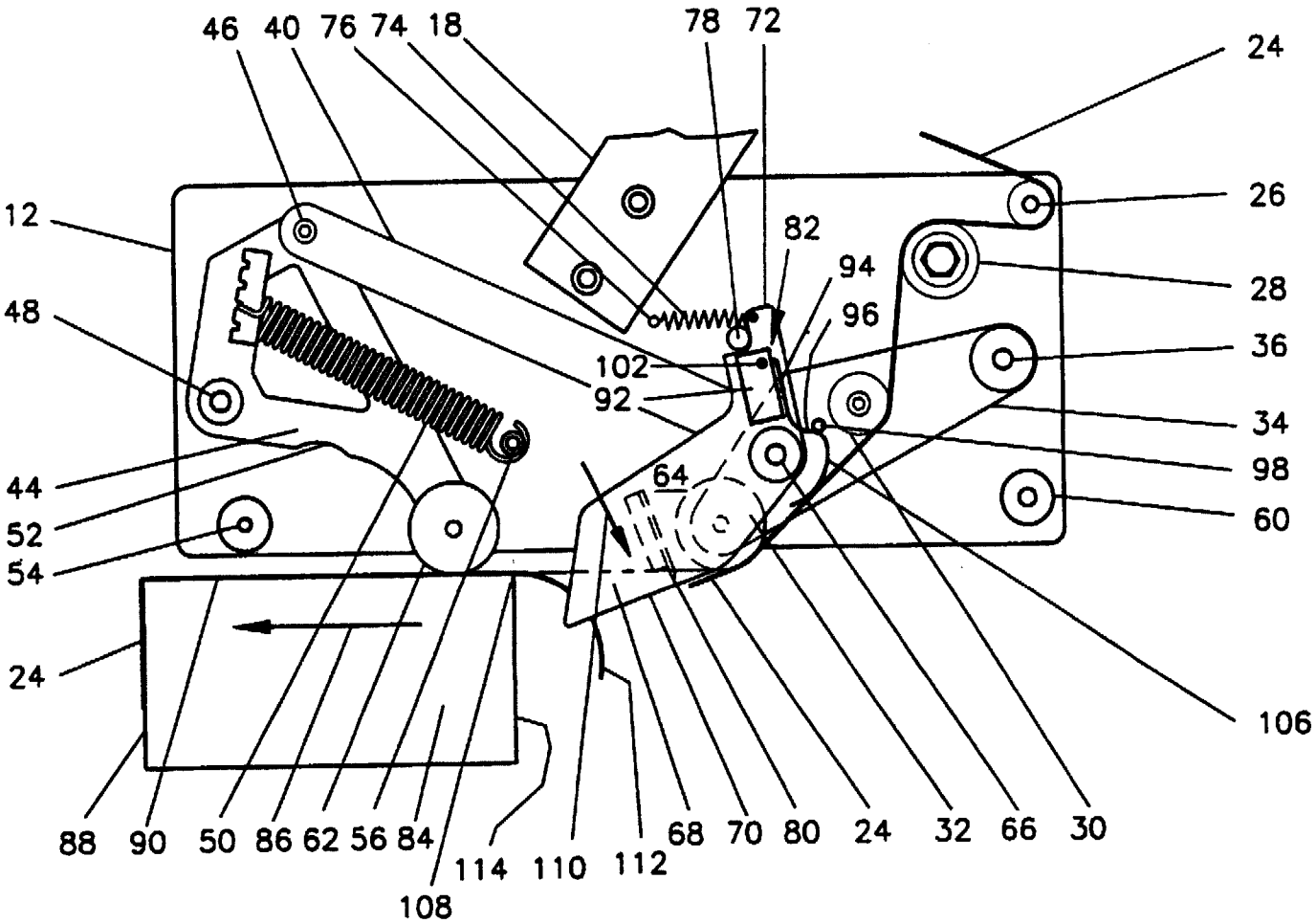
FIG. 4 shows release of the cutoff mechanism and movement of the detector to a deactivated position.
Figure 5:
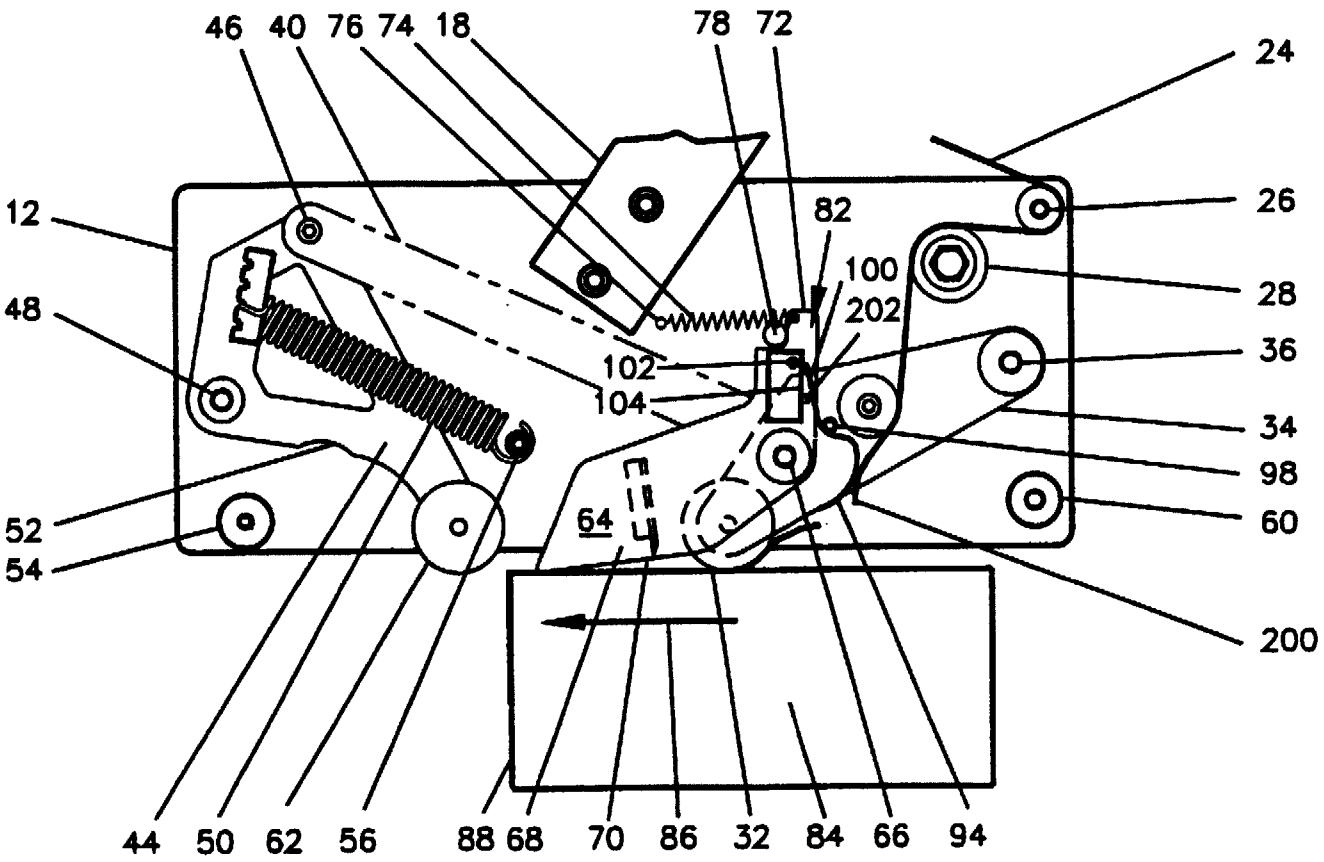
FIG. 5 is a view similar to FIG. 3 but showing the effect of a broken tape operating or triggering the detector.
Figure 6:
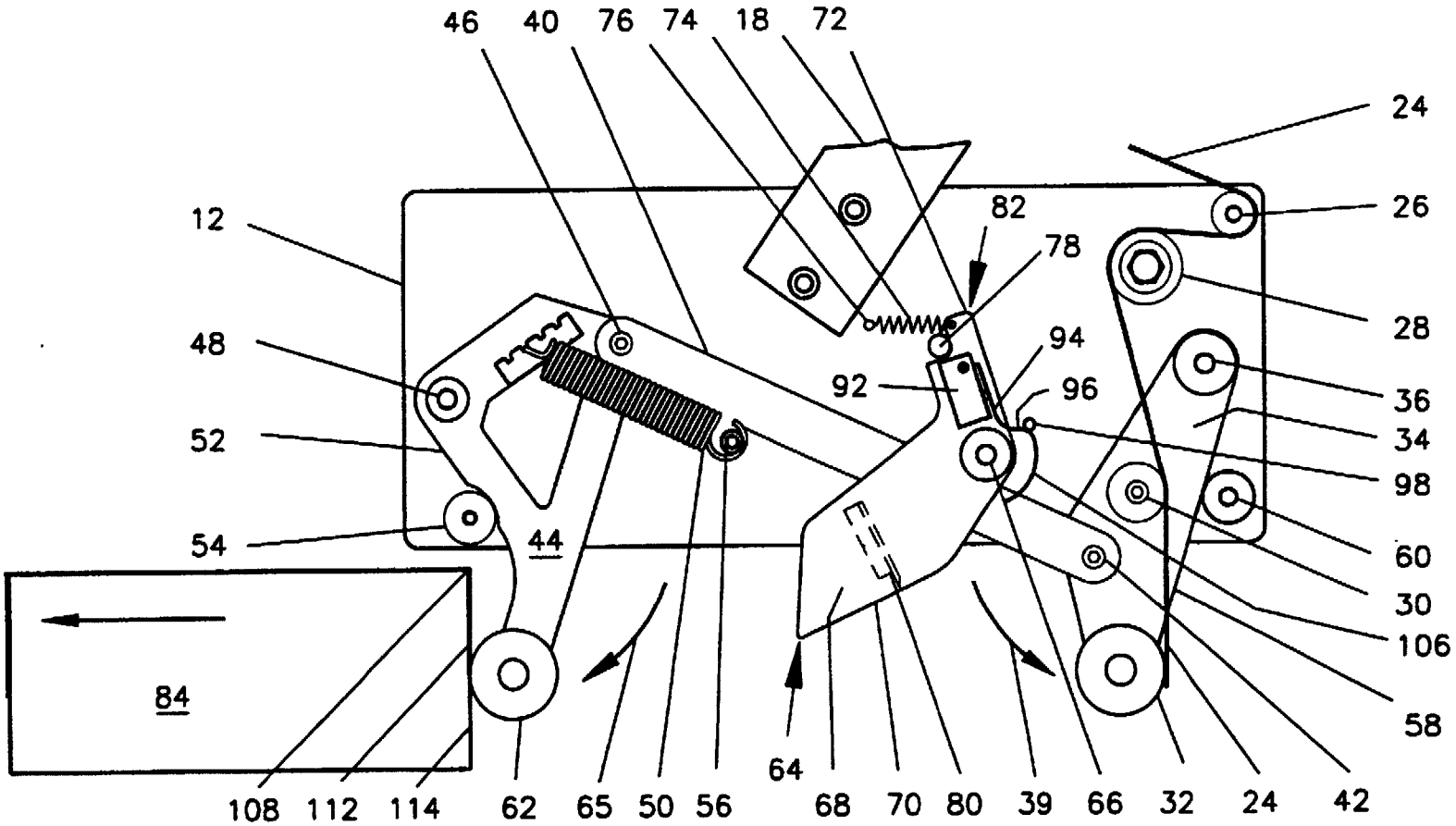
FIG. 6 shows the carton clearing the tape applicator with the rear roller forcing the tape against the trailing end of the article.

In the preferred embodiment as illustrated in FIG. 1 to 6 the cutoff mechanism 64 also functions as a mounting for the tape break detector 82 which is mounted on the arm section 72 and moves therewith as will be described below to position the detector 82 in a sensing position when the arm 68 is in a second position (retracted or cocking position of the cutoff mechanism 64) as shown in FIGS. 3 and 5.

Turning to FIG. 2 which more clearly shows the detector 82 of the present invention and the taper mechanism in the initial stages of application of a tape to the leading end of an article 84 to be taped.

The carton 84 is moved as indicated by the arrow 86 along a taping path past the applicator 10 which via roll 32 presses the adhesive side of the free end of the tape 24 extending between the guide roll 30 and the front contact roller 32 against the leading face 88 of the article (carton) 84 and moves the roller 32 and thus, the arm 34 to pivot as indicated by the arrow 38 to a position wherein the roll 32 moves along the top surface 90 of the container 84, i.e. the retracted position. Movement of the arm 34 by contact between the carton 84 and the roller 32, causes via the link 40 to move the arm 44 as indicated by the arrow 63 to retracted position wherein the face 52 is spaced from the stop 54 and the rear contact roller 62 is positioned at the height of the top edge 90 of the carton 84.

The detector 82 includes a switch box 92 and a feeler arm 94 pivotably mounted thereto as indicated by pivot pin 102 adjacent to the end of the box 92 remote from the roller 32. The feeler arm 94 is resilient and thus, deformable as a spring under pressure and has a curved cam section 96 that bears against a stop pin 98 that is fixed to the auxiliary frame 14 (see FIG. 1A).

It is apparent that in the FIGS. 1 and 2 position, the section 96 of the curve feeler arm 94 bears against the pin 98 which holds a flat section 100 of the arm 94 in close contact with the face 104 of the switch box 92, i.e. the arm 94 is pivoted as indicated at 102 to the box 92 and extends along the face 104 of the box 92, then curves away in the section 96 and is formed with a curled contacting end 106.

As the carton 84 continues through the tape applicator on the taping path, the caming surface 70 of the cutoff mechanism 64 engages the carton which lifts the arm 68 to pivot the cutoff mechanism 64 around pivot 66 and thus, moves the arm 72 to move the detector 82 and the section 96 of the feeler arm 94 away from the pin 98 so that there is no pressure between the pin 98 and the arm 94 holding the arm 94 against the surface 104 of the switch 92. However, at this point, the detector 82 is in sensing position and the front roller is in the retracted zone to relatively position the tape 24 and detector 82 so the detector may sense if there is tape in position i.e. the contacting end 106 of the feeler arm 94 is in position to bear against the tape 24 extending between the rollers 30 and 32. When there is a tape 24 in place, the curved edge 106 of the arm 94 contacts and bears against the back side (non-adhesive side) of the tape 24 and the tape 24 holds the arm 94 against the switch 92 (see FIG. 3) to prevent triggering of the detector. As indicated at FIG. 4, the detector remains activated and in sensing position until the trailing corner 108 of the box 84 passes the end of the arm 68 and releases the cam 70 so that the spring 74 forces the arm 68 to pivot around the pivot as indicated by the arrow 110 which causes the blade 80 to severe the tape 24 and provide a free end 112 having its adhesive side facing the rear wall 114 of the carton. This pivotal movement as indicated by the arrow 110 also brings the section 96 of the arm 94 against the stop 98 thereby deactivating the detector 82 so that the moving of the roller 32 and thus the tape from the retracted position does not trigger the detector 82 and the arm 34 may return to the roll 32 to its extended position (see FIGS. 1 and 6).

On the other hand, if the tape 24 is broken as indicated at 200 in FIG. 5, when the arm 68 positions the detector 82 in the sensing position illustrated in FIGS. 3, 4 and 5, i.e. where the pin 98 is not forcing the arm 94 against the surface 104 of the switch 92, the forces (spring not shown) urging the switch button 202 of detector 82 to extended position (see FIG. 5) lifts the arm 94 and moves to active position thereby triggering any suitable alarm, such an audible alarm to alert the operator that the tape is not in proper position e.g. broken.

If the tape 24 is in proper position i.e. there is no tape break, the tape 24 prevents the feeler arm 94 from moving into the position shown in FIG. 5.

To complete the taping the edge 108 of the carton 84 passes under the roll 62, the spring 50 contracts and forces the roller 62 to press the free end 112 of the tape 24 against the rear face of the carton 84 and return the roller 32 to extend position as schematically indicated by the arrows 65 and 39 which are the reverse of the arrow 63 and 38.

The specific embodiment illustrated in FIGS. 1 to 6 inclusive is the preferred arrangement of the present invention. However, other arrangements may also be used. In the preferred arrangement described both the tape 24 and the detector 82 are physically moved to relatively position them in a sensing position, if desired only the tape need be moved into proximity to the detector which may be fixed to the frame 12 (or 14) and movement of the roller 32 into retracted position used operate a suitable mechanism to activate the detector only when the detector and tape are relatively position in a sensing position for the detector to determine if the tape is in position.

Figure 7:
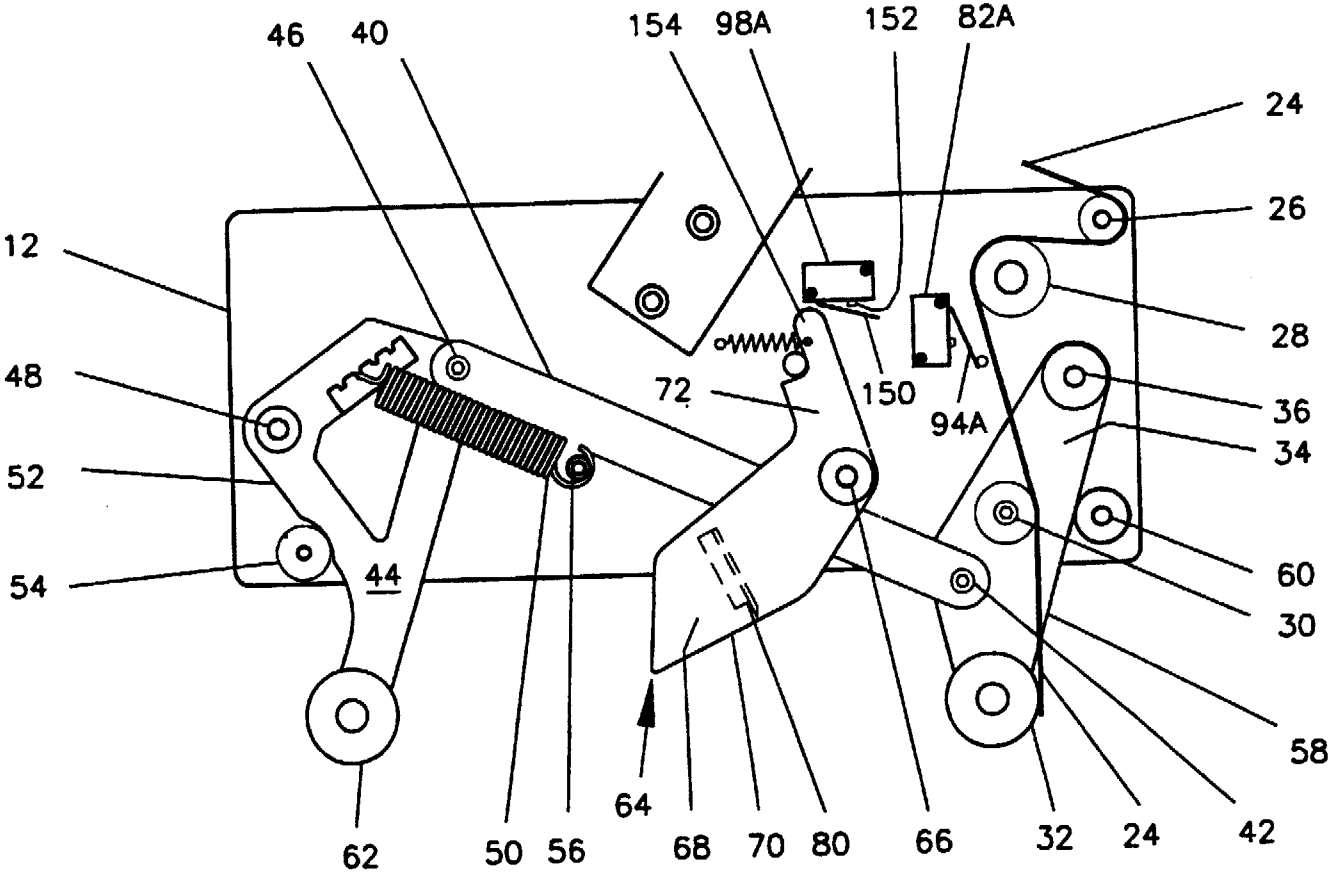
FIG. 7 is a view similar to FIG. 1 showing an alternative embodiment of the detector and a separate switch operated by the cutoff mechanism to activate the detector.
Figure 8:
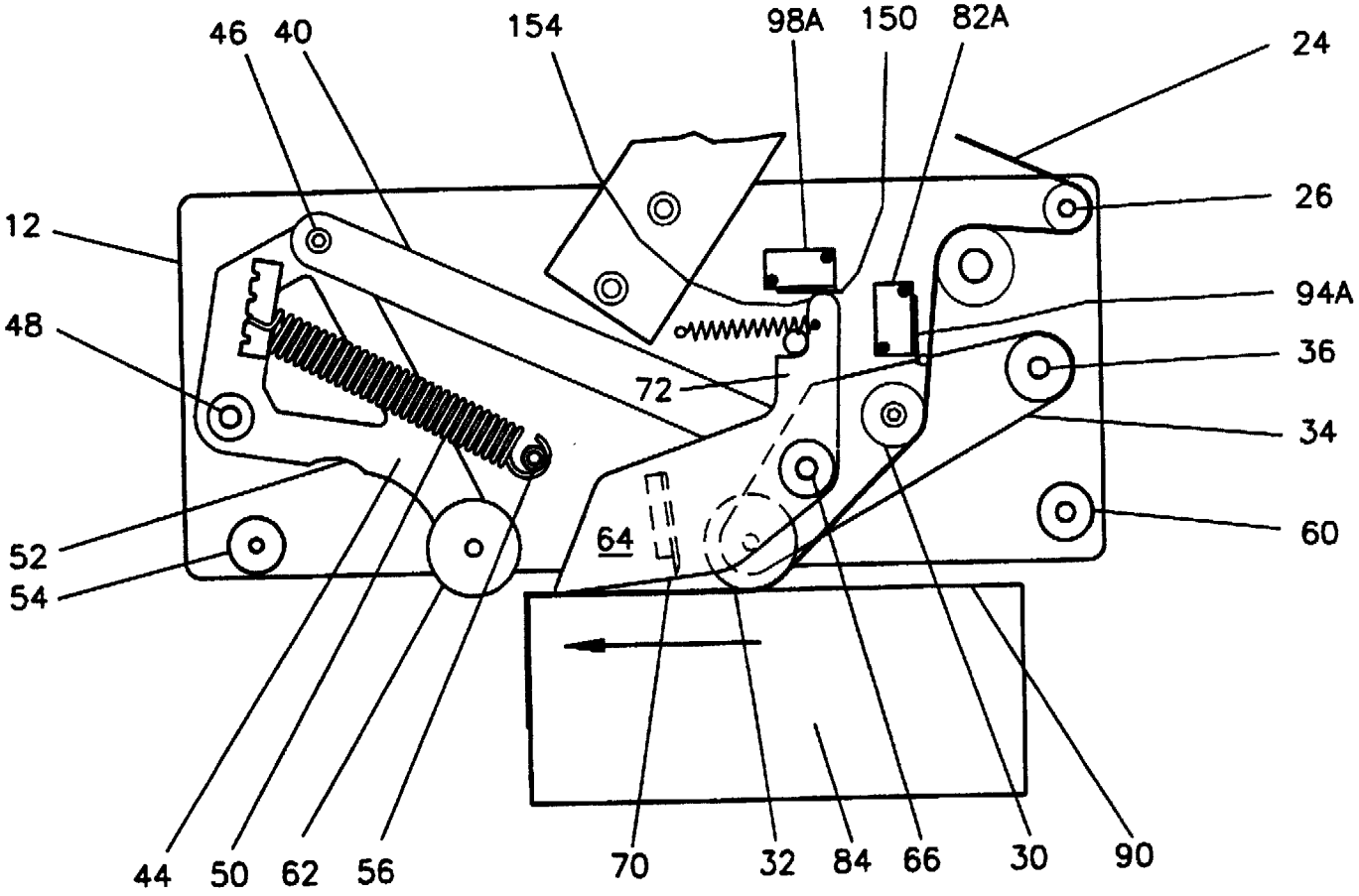
FIG. 8 is a view similar to FIG. 3 showing the FIG. 7 embodiment with the detector activated in sensing position.
Figure 9:
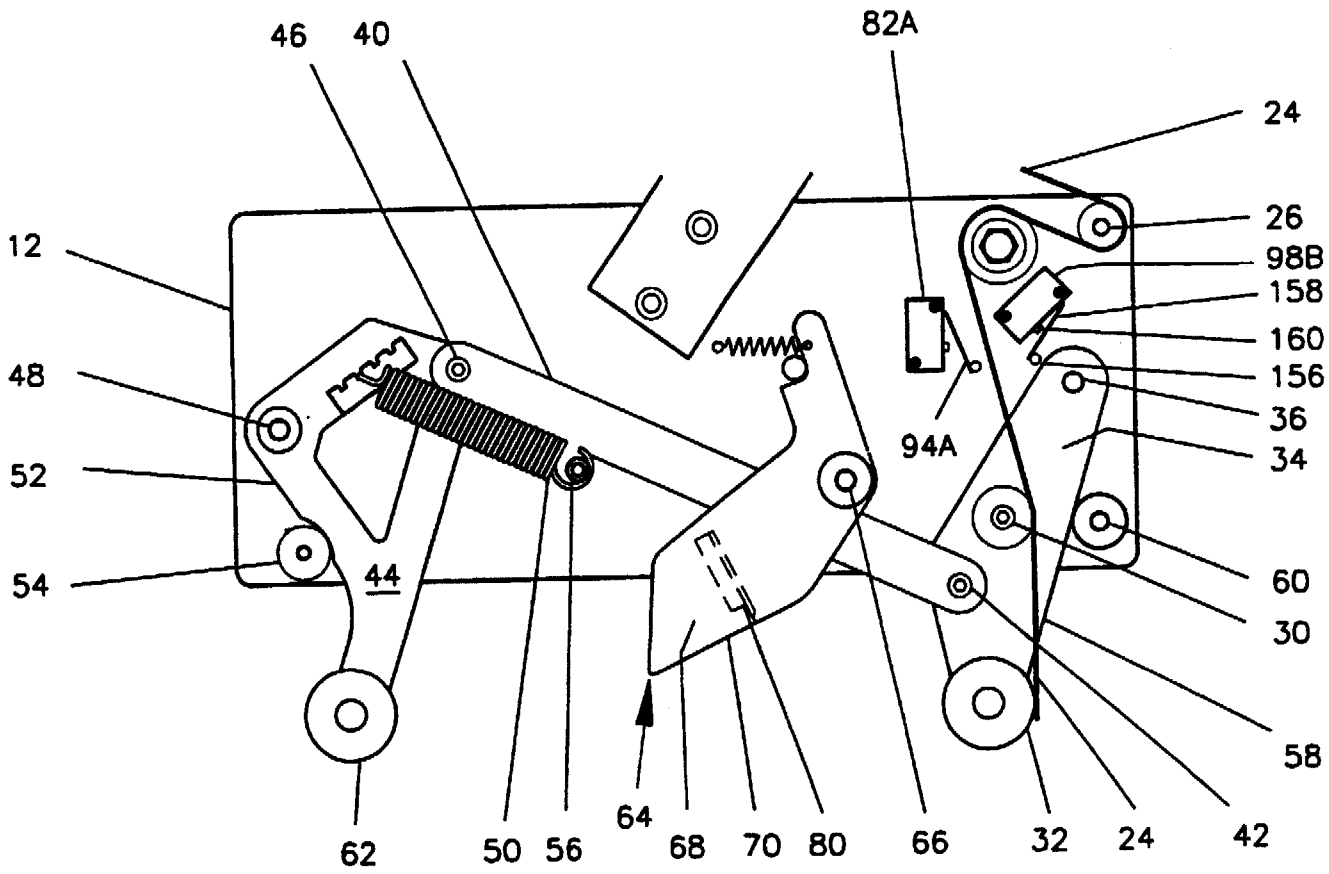
FIG. 9 is a view similar to FIG. 1 showing another alternative embodiment of a detector using a separate switch operated by movement of the front contact roller to activate the detector.
Figure 10:
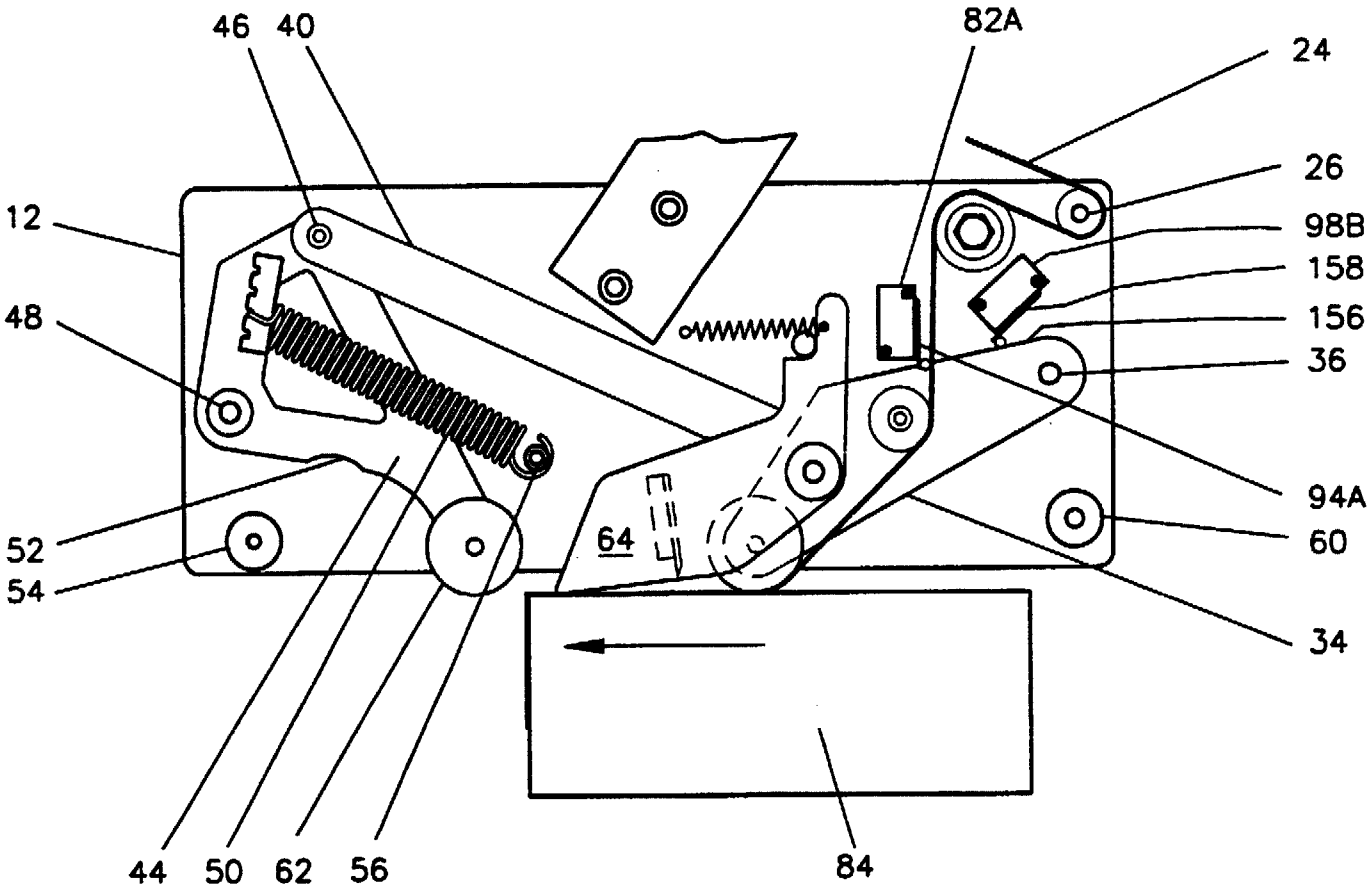
FIG. 10 is a view similar to FIG. 3 showing the FIG. 9 embodiment with the detector in activated in sensing position.

FIGS. 7 to 10 show embodiments employing two switches one of which function as a detector switch 82A operated to one condition when movement is impaired by contact of a feeler arm 94A with the tape 24 if there is a tape in position or permitted to switch to a second position if the feeler arm 96 is not held in position by the tape 24. The other switch is the activating switch 98A (FIGS. 7 and 8) or 98B (FIGS. 9 and 10) and is used to active the detector 82A only when the front roller 32 is in retracted position (FIG. 8 and 10).

In the FIG. 7 and 8 embodiment the activating switch 98A has a feel or wiper arm 150 that manipulates a contact element 152 to switch the switch 98A. The switch 98A is fixed to the frame 12 or 14 as appropriate in a position so that the free end 154 of the arm 72 moves the arm 150 and thus the contact 152 between an extended position as shown in FIG. 7 with no box 84 in position and a depressed position shown in FIG. 8 wherein the box 84 moves the mechanism 64 into cocked position which moves the end 154 of the arm 72 to force the arm 150 toward the switch 98A and shift the position of the contact 152.

In the FIG. 9 and 10 embodiment the activating switch 98B is mounted fixed to the frame 12 or 14 and operates in essentially the same manner as the switch 98A but by contact of the surface 156 of the arm 34 with the feeler arm 158 of the switch 98B to shift the position of switch the contact 160 of the switch 198B. The arm 34 is moved by engagement between the roller 32 and box 84 between the extended position where the switch 98B is in a position wherein the switch 82A is deactivated (FIG. 9) and to a retracted position wherein the switch 98B is in a position the detector switch 82A is activated. (FIG. 10).

In either of the embodiment of FIG. 7 to 10 inclusive the switches 82A and 98A or 98B will be connected so that when switch 82A is in activated position i.e. switch 98A or 98B are in the positions shown in FIGS. 8 and 10 respectively if the position of the switch 82A is not changed by contact with the tape 24 the alarm is set off.

Instead of activating a switch 82 Or 82A or the like by using a contact feeler arm 94 or 94A, a non-contact switching device could be used wherein it is activated only if the roller 32 is in the retracted position illustrated in FIGS. 2 and 3 and preferably, only when the cutoff mechanism is also in the retracted position, as this indicates that the box 84 is fully in position under the taping head. With a non-contact sensor, a suitable hood could be moved from masking position to exposing position to activate the sensor to sense the tape only when the elements are in the position shown in FIG. 3. A non-contact detector such as sensing a reflected light beam is significantly more expensive than the simple switch mechanism and for this reason, the switch mechanisms are preferred.

Figure 11:
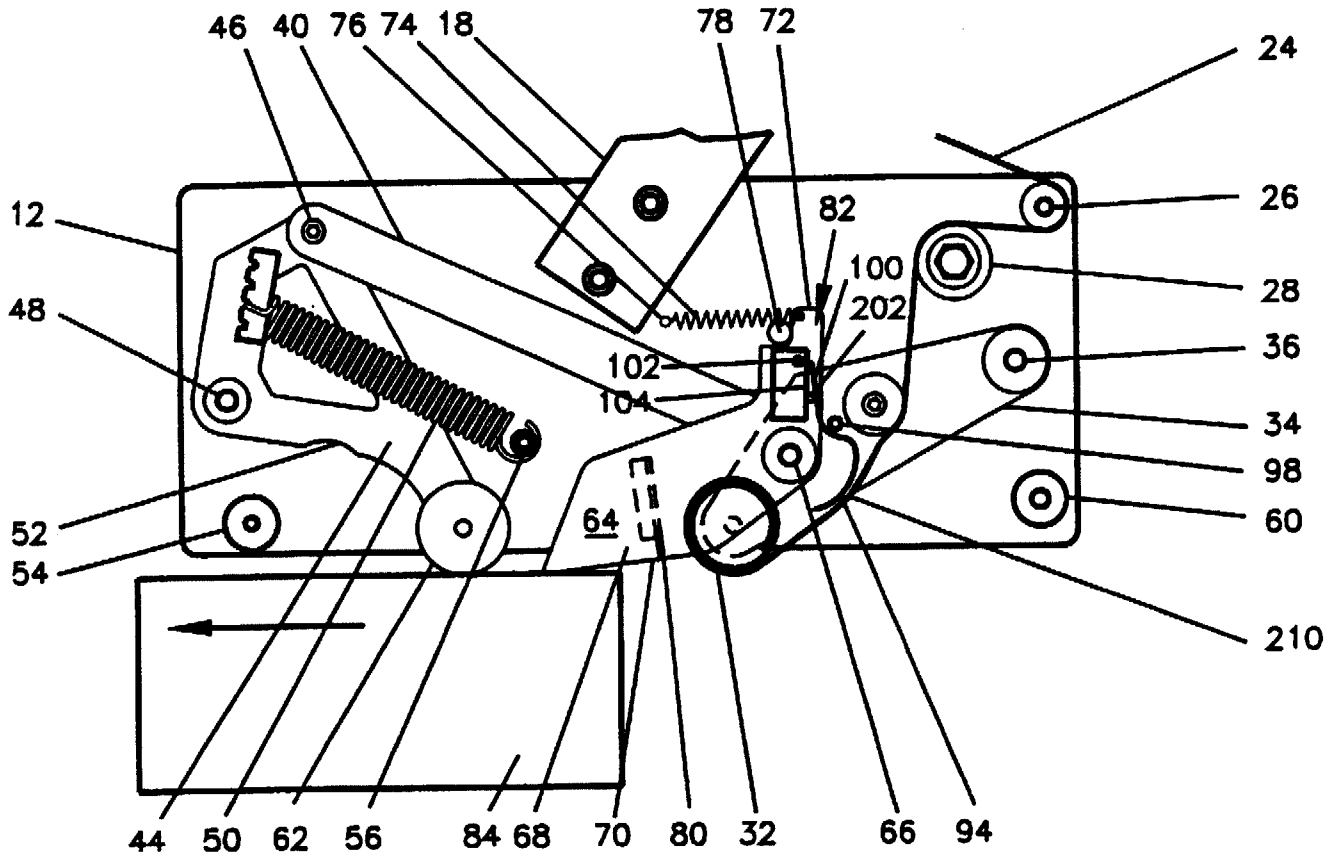
FIG. 11 is a view similar to FIG. 5 but wherein the leading end of the tape has wrapped about the front contact roller.

In FIG. 11, the detector 82 is shown in position to detect that the tape 24 is not on a normal tape path i.e. is deflected therefrom as indicated at 210 which permits the arm 94 to be released and signal there is a problem in the taping head. In FIG. 11 the particular problem being detected is one wherein the free end of the tape 24, after being cut by the cutter 80, curls around the roller 32 which is free to rotate and thus, does not maintain tension in the tape 24 to hold the tape in its normal path and the tape does not prevent the feeler 94 from moving to its biased position away from the detector surface 104. As can be seen in FIG. 11, this detection of the tape 24 as not being in the tape path is completed before the cam 70 of the cut-off mechanism 64 passes over the trailing end of the article 84. In this manner the detector 82 detects, not only a broken tape as above described, but also that the tape is not under tension and is deflected from the tape path while the article 84 is in position holding cutoff mechanism in cocked position before it has been released to cut the tape 24.

Figure 12:
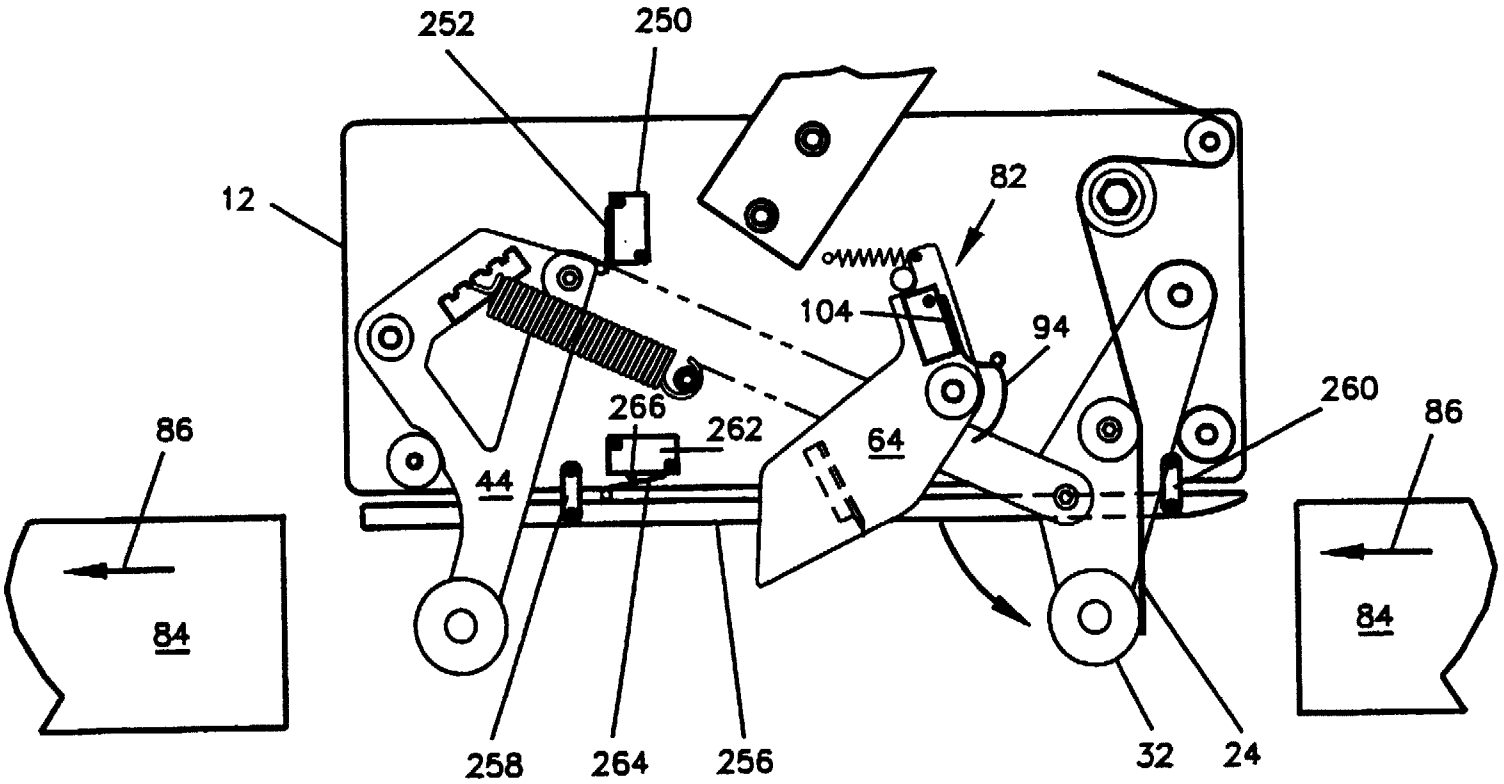
FIG. 12 is a view similar to FIG. 1 further including a roller position detector and an article detector in the system.

The arrangement shown in FIG. 12 is essentially the same as the arrangement shown in FIG. 1, except there has been added, a roll position detector 250 which has feeler arm 252 (similar to the arm 94), that when it bears against a portion of the rear arm 44 holds the detector 250, i.e. the switch button 254 (see FIG. 14) in a depressed position.

The embodiment of FIG. 12 further includes a detector slide 256 extending on the direction of movement of the article 84 as indicated by the arrows 86 along the path of travel of an article 84 through the taping operation. The detector slide 256 is suspended from the bottom of the tape frame 12 via a pair of parallel links 258, 260 to permit the slide 256 to swing from the position shown in FIG. 12 to the position shown in FIG. 13 and back to the position shown in FIG. 14.

Figure 13:
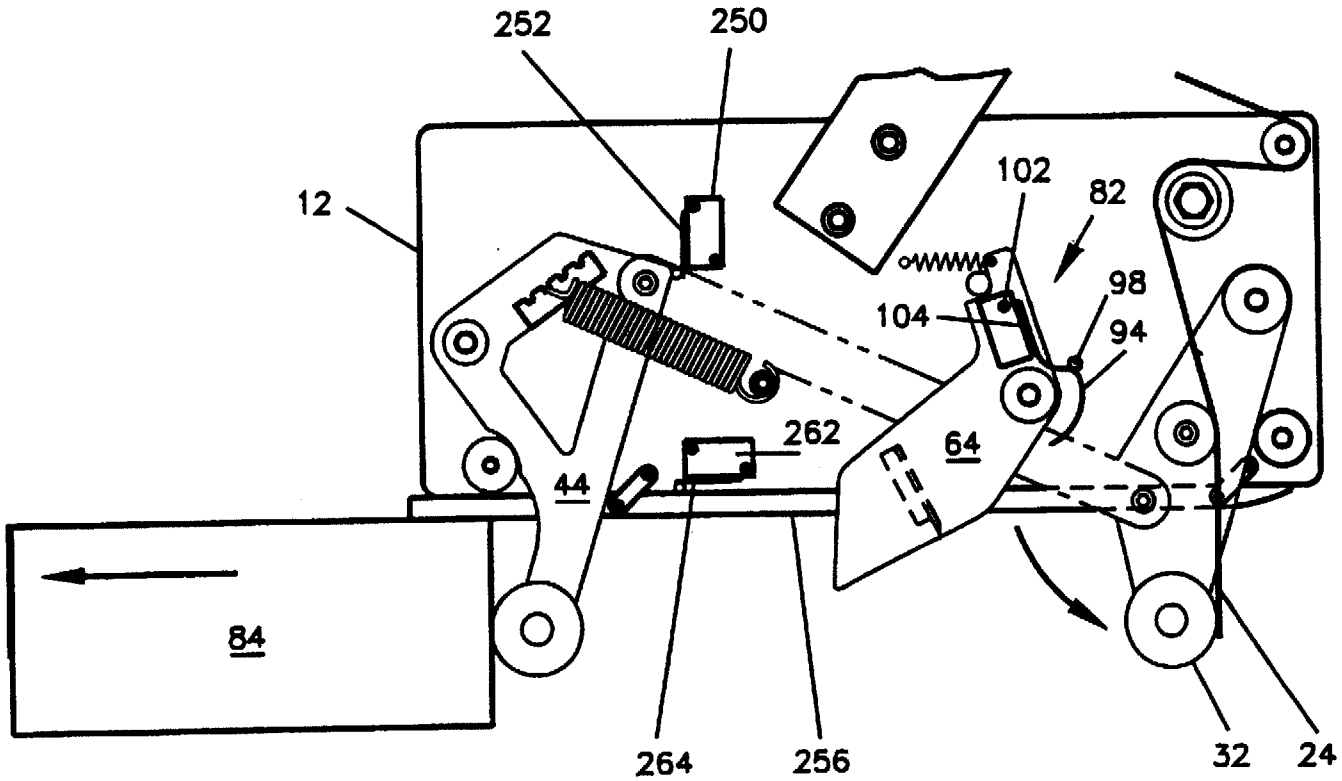
FIG. 13 is a view similar to FIG. 12 showing an article in the taping zone or position.

An article detector 262 having a feeler arm 264 and a switch button 266, is positioned so that the feeler arm 264 senses the position of the slide 256 and moves from the position shown in FIG. 12 wherein the button 266 is extended when there is no article 84 in the taping position as defined by the length of the slide 256. When there is no article 84 in taping position along the taping path, i.e. supporting the slide 256, the detector 262 indicates there is no article 84 in position supporting the slide 256 and the button 266 is in extended position. In FIG. 12, the detector 250 senses that the roller 32 is in fully extended position when there is no article in the taping position thus, no alarm is triggered. In FIG. 13, there is an article 84 still forcing the slide 256 upward thereby moving the detector 262, i.e. the switch button 266 to deactivating position wherein the feeler 264 depresses the switch 266 which deactivates the detector 250 and prevents triggering of an alarm, for example, the switches 254 and 266 are connected in series with suitable alarm (not shown) so that both detectors 250 and 2262 must be in conducting condition to trigger an alarm.

Figure 14:
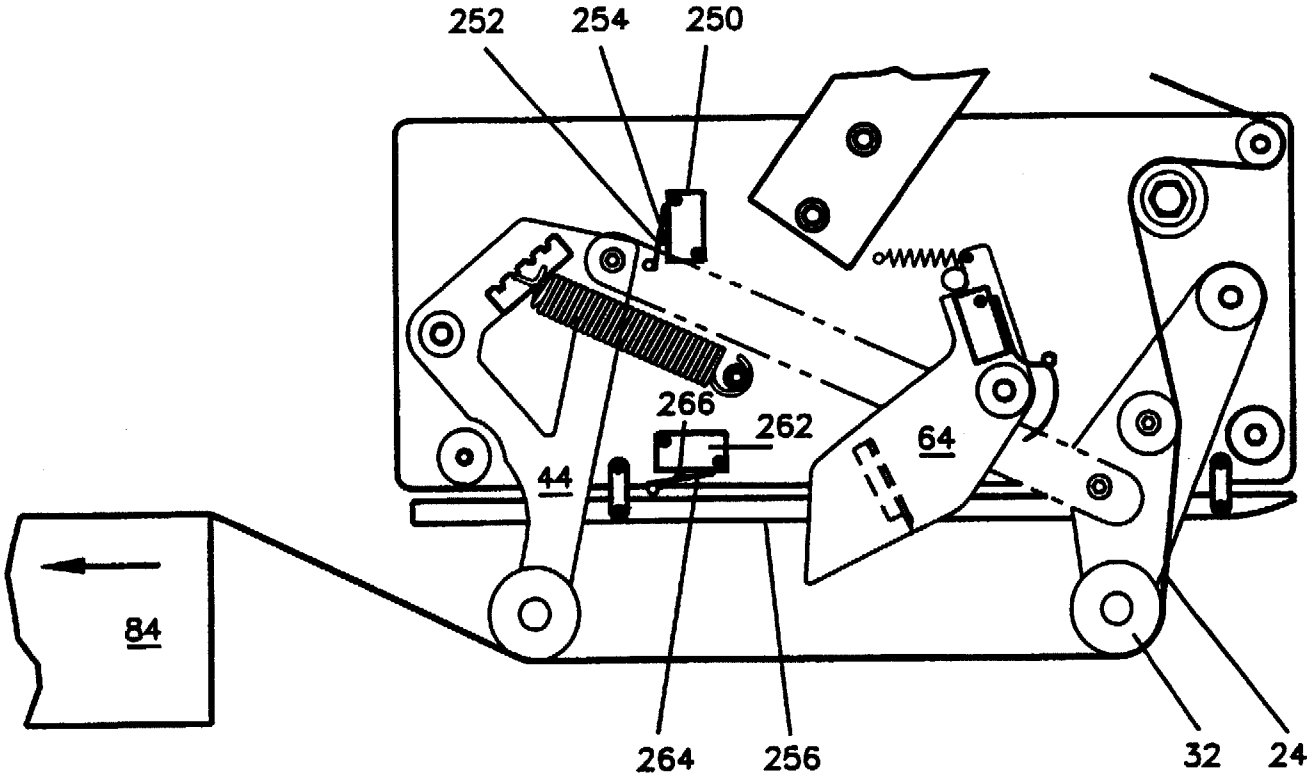
FIG. 14 is a view similar to FIG. 13 showing the taper after an article has left the taping zone but the cut-off mechanism has failed to be cut the tape.

When there is no article supporting the slide 256 and when the tape 24 has not been cut by the cut-off mechanism 64, the tape extends from the rear of the container 84 and prevents the full retraction of the roller 32 to its extended position which positions the feeler arm 252 spaced from the arm 44 which permits the switch button 254 to be extended. Similarly there is no article 84 in the taping position so that the button 266 is extended. In this position both detectors 250 and 266 are activated at the same time so that both the switch buttons 254 and 266 are in extended position conducting position as illustrated in FIG. 14 and the circuit is completed. This completed circuit can be use to trigger an alarm system indicating that the tape did not cut off.

Failure of the tape cutting mechanism may also be detected using a single detector such as the detector 250 to activate an alarm timer 280 when the roll 32 leaves its extended position and, after a preselected period of time as determined by the alarm timer 280 (see FIG. 15), if the roll 32 has not returned to extended position the timer 280 sounds the alarm. The system shown in FIG. 15 is preferred to that shown in FIG. 12, 13 and 14 as it is less complicated.

Figure 15:
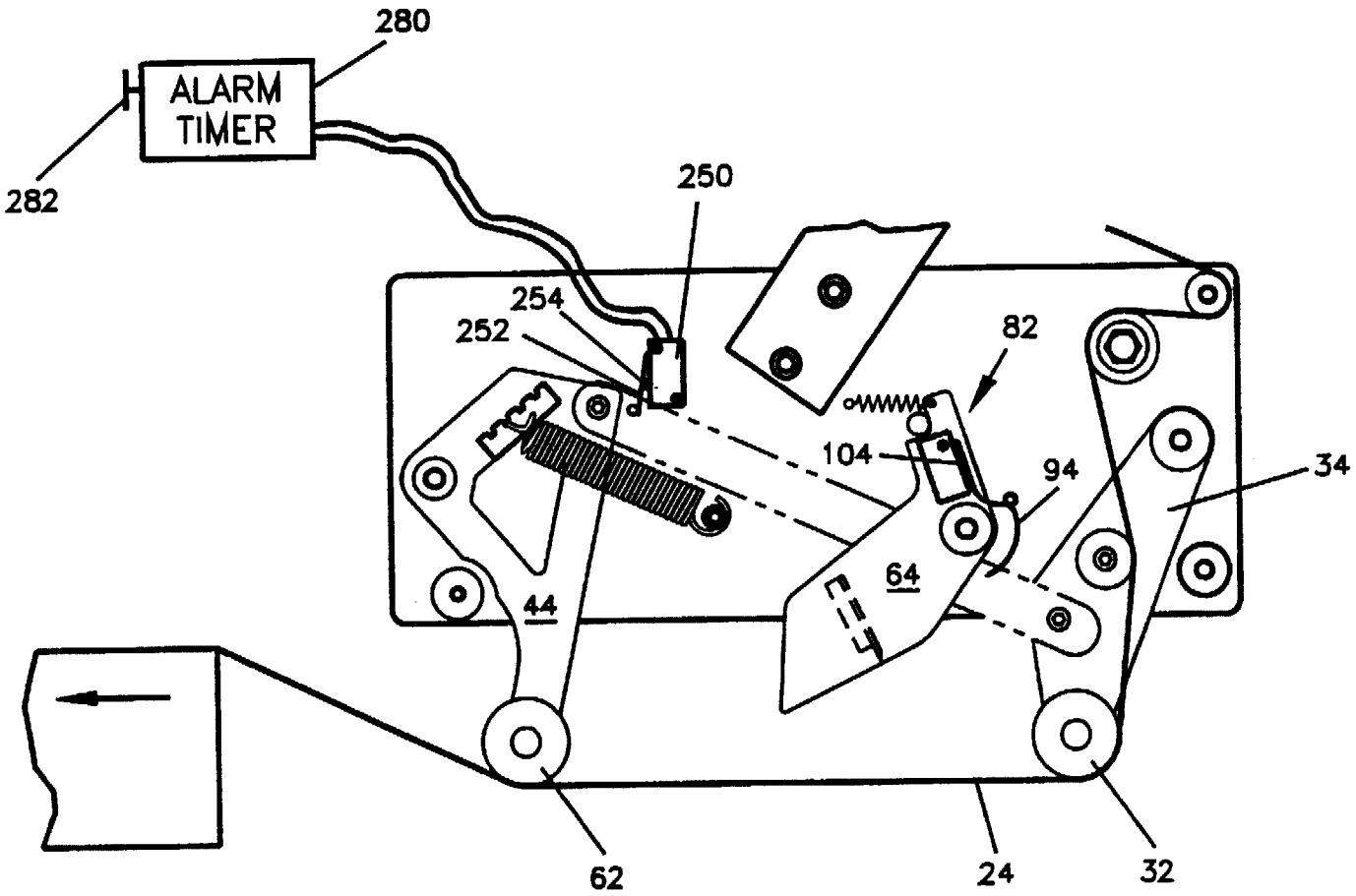
FIG. 15 shows a further embodiment of the present invention wherein the action of the roll position detector to activate an alarm is controlled by a timer.

In the arrangement shown in FIG. 15 as an article enters the system, the roller 32, arms 34, 44, etc. are moved from their extended position shown, for example, in FIGS. 1 and 12 toward a retracted position which moves the arm 44 away from the feeler arm 252 and permits the switch button 254 to extend and complete a circuit to the alarm timer 280 which triggers the alarm timer 280. The time set on the alarm timer 280 is dependent on the rate of feed through the taper and the length of the article being taped and generally will simply be manually set via the adjustment knob 282 to the normal time required for the taping up operation to be completed and the contact roller 32 to move back to its extended position plus a selected additional time For example, if it takes one second to move the article through the taping path and complete the taping operation the timer 280 may be set for 1½ seconds so that it would not trigger an alarm for at least 1½ seconds after the detector 250 has moved to the position shown in FIG. 15 with the contact 254 extended. Normally, if the tape 24 is cut-off buy the cut off mechanism 64 and the article 84 has been taped and cleared the roller 62, the arms 44, 34 and rollers 32 and 64 move to their extended position which moves the feeler arm 252 back into the position shown in FIG. 12 and resets the timer 280 to the zero time position. If the tape 24 is not cut and extends as illustrated in FIG. 15 thereby preventing the roller 32 from moving to the extended position, the switch 254 remains in extended position longer than the 1½ seconds or whatever time is set in the alarm timer 280 and the alarm timer 280 then triggers the alarm indicating that there is a problem with the tape head.

Having described the invention, modifications will be evident to those skilled in the art without departing from the scope of the invention as defined in the appended claims.

I claim:

1. A tape applicator having detector for detecting the operation of a tape in said tape applicator adjacent to a point of application of the tape to an article being taped, said tape applicator having a frame, a front contact roller mounted on said frame for movement relative to said frame between an extended inactive position and a retracted operating position, means to provide tape to said front roller along a tape path, a detector means having a feeler arm, said feeler arm positioned to bear against said tape on said tape path when said detector means and said front roller are relatively moved into a sensing position, means for mounting said detector means, means for activating and deactivating said detector means, said means for activating and deactivating said detector means being constructed for activating said detector means when said front roller is in said retracted position and said detector means in said sensing position relative to said tape path to permit said detector means to detect whether said tape is in said tape path approaching said front roller when tape is being applied to said article by said tape applicator and for deactivating said detector means when said front roller is outside of said retracted position.

2. A tape applicator as defined in claim 1 wherein said means for mounting said detector means moves said detector means relative to said frame into said sensing position from a retracted position.

3. A tape applicator as defined in claim 2 wherein said means for mounting said detector means comprises a cam means mounted on said frame for movement from a first to an article second position by movement of said article being taped along a path past said applicator, said movement of said cam means to said second position positioning said detector means in said sensing position.

4. A tape applicator as defined in claim 2 wherein said means to activate and deactivate and deactivate said detector means includes a pin fixed to said frame, said feeler arm and said pin being constructed and positioned to bear against each other and prevent activation of said detector means when said detector means is not in said sensing position, and to releases said feeler arm when said detector means is in said sensing position and said feeler arm is in position to contact said tape in said path and to permit movement of said feeler arm to trigger said detector means if such movement of said feeler arm is not prevented by contact of said feeler arm with said tape on said path.

5. A tape applicator as defined in claim 3 wherein said means to activate and deactivate and deactivate said detector means includes a pin fixed to said frame, said feeler arm and said pin being constructed and positioned to bear against each other and prevent activation of said detector means when said detector means is not in said sensing position, and to releases said feeler arm when said detector means is in said sensing position and said feeler arm is in position to contact said tape in said path and to permit movement of said feeler arm to trigger said detector means if such movement of said feeler arm is not prevented by contact of said feeler arm with said tape on said path.

6. A tape applicator as defined in claim 4 wherein said cam means is positioned downstream of said from roller along said path of movement of an article being tape so that said article being taped displaces the cam mean.

7. A tape applicator as defined in claim 5 wherein said cam means is positioned downstream of said front roller along said path of movement of an article being tape so that said article being taped displaces the cam mean.

8. A tape applicator as defined in claim 6 wherein said cam means mounts a cutoff knife.

9. A tape applicator as defined in claim 7 wherein said cam means mounts a cutoff knife.

10. A tape applicator as defined in claim 1 wherein said means for mounting mounts said detector means in fixed position relative to said frame.

* * * * *